175-40

1/26/82 XR 4,312,414 SR

United States Patent [19]

Park

[11] 4,312,414

[45] Jan. 26, 1982

[54] METHOD AND APPARATUS FOR OBTAINING SATURATION DATA FROM SUBTERRANEAN FORMATIONS

[75] Inventor: Arthur Park, Odessa, Tex.

[73] Assignee: Diamond Oil Well Drilling Company, Midland, Tex.

[21] Appl. No.: 152,849

[22] Filed: May 23, 1980

[51] Int. Cl.[3] ..... E21B 25/06; E21B 25/10

[52] U.S. Cl. ..... 175/59; 175/40; 175/42; 175/249

[58] Field of Search ..... 175/249, 250–253, 175/244, 226, 58, 59, 308, 4, 20, 77, 78, 403

[56] References Cited

U.S. PATENT DOCUMENTS 1,815,391 7/1931 Zublin et al. .
1,857,693 5/1932 Quintrell .
1,859,950 5/1932 Zublin ..... 175/249
2,779,195 1/1957 Simon ..... 175/249 X
3,383,131 5/1968 Rosfelder .
3,525,409 8/1970 Holzman .

*Primary Examiner*—Stephen J. Novosad
*Attorney, Agent, or Firm*—Richards, Harris & Medlock

[57] ABSTRACT

An apparatus (10) and method for obtaining oil and water saturation data from subterranean formations includes a drill bit (12) for boring a well core (26) containing the fluids. A core-catcher bowl (18) guides the well core (26) in the apparatus (10). An outer barrel (14) is attached to the drill bit (12) and contains the core-catcher (18). An inner liner (20) positioned in the outer barrel (14) receives the well core (26). An oil absorbent sponge-like member (22) is contained in the inner liner (20) with a diameter (24) for receiving the well core (26). The oil absorbent sponge-like member (22) absorbs the fluids contained in the well core (26).

36 Claims, 5 Drawing Figures

METHOD AND APPARATUS FOR OBTAINING SATURATION DATA FROM SUBTERRANEAN FORMATIONS

TECHNICAL FIELD

This invention relates to obtaining saturation data from subterranean formations, and more particularly to a device for absorbing and storing subterranean fluids from a well core.

BACKGROUND ART

In the drilling of an oil or gas well, a sample of the formation which has been tapped is often analyzed to determine the quality of the formation. The information obtained includes the amount of oil and gas, carbon dioxide, and water contained in the formation. This information is used in various ways, such as deciding whether the formation will be produced, or whether the well will be capped and abandoned.

Prior art methods of analyzing the content of the subterranean formation have involved drilling a well core in the formation with a well coring device. The well core is retrieved and analyzed.

However, in such prior art methods, significant information concerning the subterranean formation is often lost due to the pressure differential between the subterranean formation and the surface of the earth where the analysis is conducted. Subterranean formations generally contain fluid and gas under enormous pressure. During the taking of the core sample, this pressure is opposed by a column of mud. When the core is retrieved from the well, the pressure is released, causing the fluids contained in the formation to flow or "bleed" from the core. Thus, prior art cores have often lost a significant fraction of the fluids contained in the core. Accurate analysis without an accounting for the lost fluid is difficult.

A prior method of accounting for the lost fluid has been to maintain the core under pressure after it has been drilled and then freezing the core until analysis in a lab.

A need has thus arisen for a convenient and inexpensive method and apparatus for accurately determining information regarding fluid in subterranean formations.

DISCLOSURE OF THE INVENTION

In accordance with the present invention, a method and apparatus for obtaining saturation data from subterranean formations are provided.

In accordance with the present invention, an apparatus for recovery of subterranean fluids is provided with apparatus for boring a well core containing the subterranean fluids. A container is attached to the boring apparatus and receives the well core. An absorbing member is contained in the container and is proximately positioned the well core for absorbing and storing the subterranean fluids.

In accordance with another aspect of the present invention, a core boring device for recovering fluids from a well core includes a casing for containing the well core and connecting the core boring device to a drill string. An oil and water absorbent material which absorbs the fluids is contained in the casing and has a diameter for tightly receiving the well core.

In accordance with yet another aspect of the present invention, a device for recovering subterranean fluids is provided with a drill bit for boring a well core containing the fluids. A core-catcher is located in an outer barrel and holds the well core after it has been cut. An inner barrel positioned in the outer barrel receives the well core and contains a hollow, oil absorbent member. The oil absorbent member has a diameter which tightly receives the well core and absorbs the fluids contained in the well core.

In accordance with yet another aspect of the present invention, a method of obtaining subterranean fluid from an oil well comprises the steps of positioning an oil absorbent member with an inner diameter in a container. A device for boring is associated with the container and a well core is bored in the oil well. The resulting well core is inserted in the inner diameter of the oil absorbent member. When the well core and the member are removed from the oil well, the member absorbs the fluid which migrates from the well core. The fluid is then subsequently removed from the member for analysis.

BRIEF DESCRIPTION OF THE DRAWINGS

A more complete understanding of the invention and its advantages will be apparent from the following Detailed Description taken in conjunction with the accompanying drawings in which.

DETAILED DESCRIPTION

Figure 1:
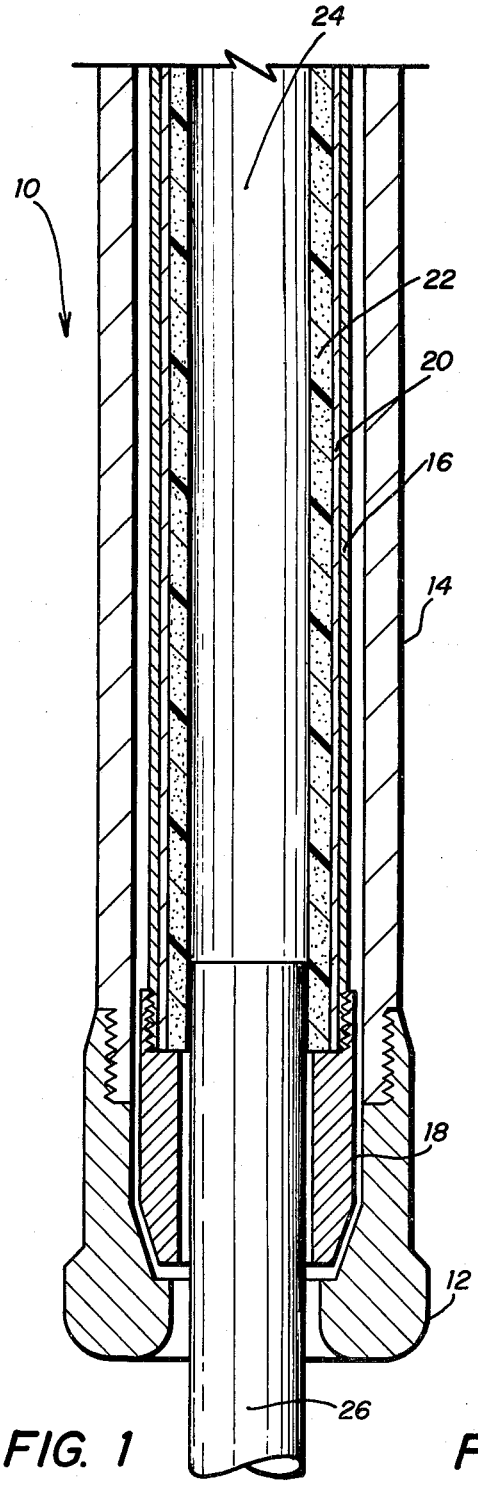
FIG. 1 is a cross-sectional side view of the present invention.

The present invention 10 includes a core bit 12 which bores through the subterranean formation. The core bit 12 may comprise any suitable type bit such as a diamond bit and is connected to an outer barrel 14 which contains a metal inner barrel 16. Metal inner barrel 16 is connected to a core-catcher bowl 18 located near the core bit 12. The core-catcher is not shown for ease of illustration and description of the invention. Metal outer barrel 16 generally has slits or a check valve (not shown) at the stem to release any excessive pressures which might build. A plastic inner liner 20 fits inside metal inner barrel 16. A sponge-like hollow, cylindrical member 22 is attached to the plastic inner liner 20 and has a hollow diameter 24.

The core bit 12 which bores a cylindrical well core 26 from the oil and gas bearing formation derives its rotative force from a drill string (not shown) connected to suitable apparatus located at the surface of the oil or gas well. The core-catcher bowl 18 supports the well core 26 in the present invention 10. The hollow diameter 24 of the sponge-like member 22 is dimensioned tightly to fit about the well core 26 cut by the core bit 12. In the illustrated embodiment, sponge-like member 22 is in the shape of a long, hollow cylinder extending the length of inner liner 20.

Figure 2:
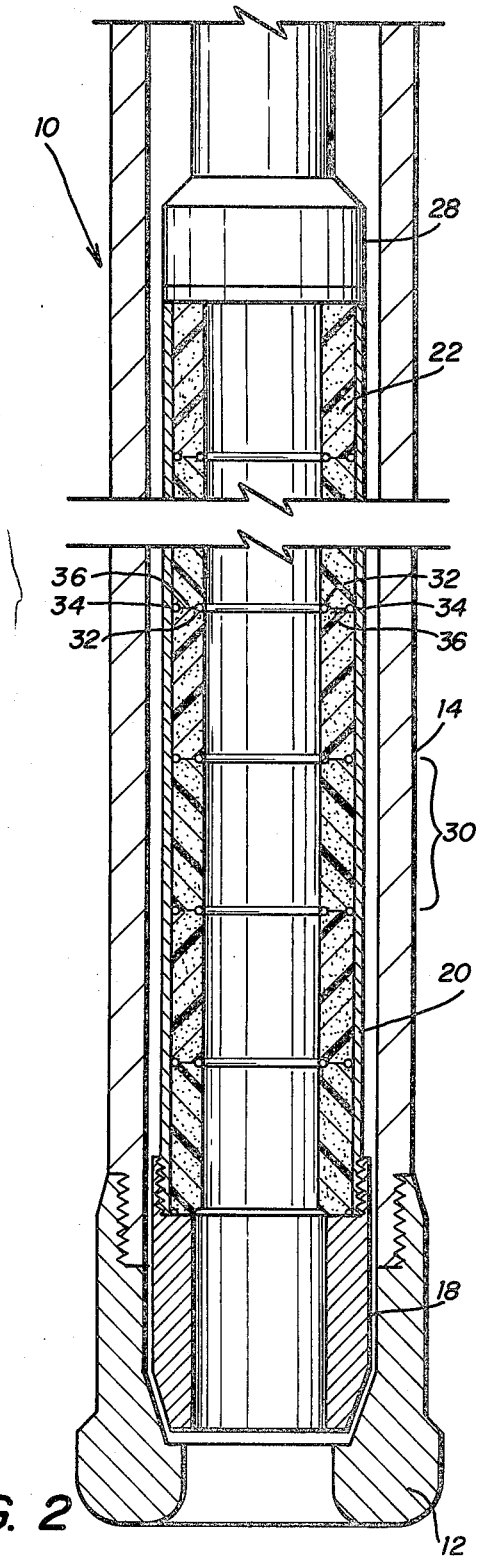
FIG. 2 is a cross-sectional side view of an alternate embodiment of the present invention.

FIG. 2 discloses an alternate embodiment of the present invention 10 which is constructed without a metal inner barrel 16. The core bit 12, core-catcher 18, and outer barrel 14 are as described heretofore. A swivel 28 attaches the inner liner 20 to support structure in the outer barrel 14, as will be evident to those of skill in the art.

In the embodiment disclosed in FIG. 2, the sponge-like member 22 is composed of a plurality of sections or segments 30. The sections or segments 30 are separated by inner O-rings 32, outer O-rings 34, and elastic webbing 36. O-rings 32, 34 and webbing 36 form an oil and water impermeable barrier.

Figure 3:
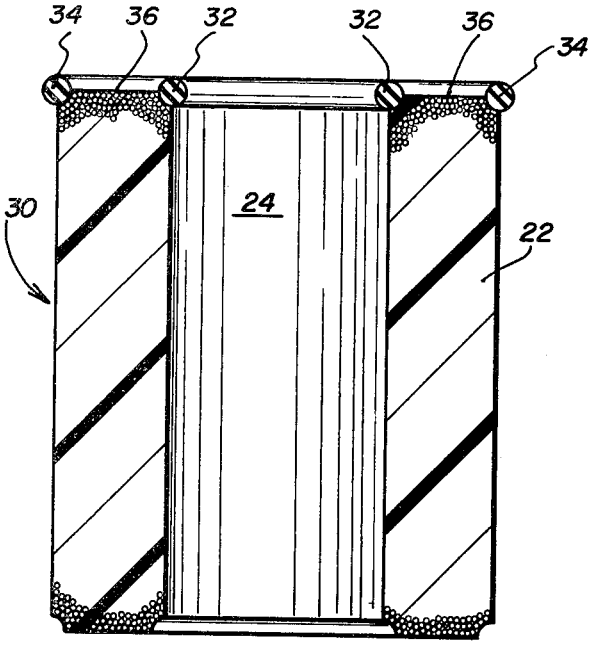
FIG. 3 is a cross-sectional side view of a section of the invention.
Figure 4:
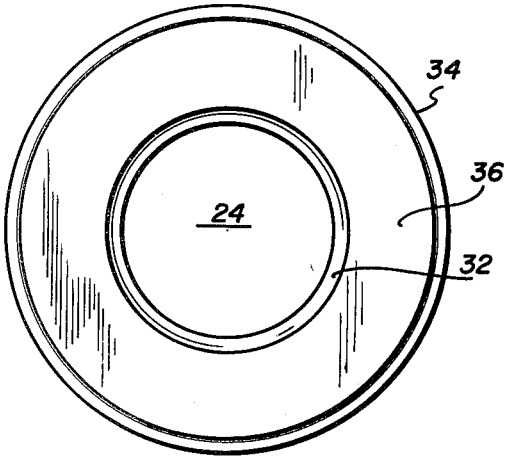
FIG. 4 is a top view of FIG. 3 of the present invention.

FIGS. 3 and 4 illustrate a section or segment 30 of the present invention as disclosed in the embodiment in FIG. 2 Inner O-ring 32 fits about the diameter 24 where the well core 26 is received. Inner O-ring 32 is dimensioned to fit snugly about the well core 26 when the well core 26 is in the diameter 24. The inner and outer O-rings 32, 34 and elastic webbing 36 separate each segment 30 from the other segments 30. Fluids which flow or bleed from the well core 26 are confined to each segment 30, so that the fluids do not run together and become mixed. In this manner, more accurate analysis of the contents of the subterranean formation can be performed. Since the diameter 24 fits tightly about the well core 26, fluid does not collect between the sponge-like member 22 and the well core 26, thus preventing gravity separation of the fluids from the well core 26 after they have "bled" out. The liner 20 is not required in the embodiment illustrated in FIGS. 2, 3 and 4.

The segments 30 may be constructed of different lengths. Convenient lengths have been between six inches and one foot. The choice of length and number of segments 30 is made to insure accurate analysis of the fluids contained in the subterranean formation, as will be evident to thse of skill in the art. A sufficient number of segments 30 to make a thirty to sixty foot sponge-like member has been suggested.

Different materials can be used in the oil absorbent or oil wet-sponge-like member 22. The sponge-like member 22 must have a high permeability and porosity, yet be mechanically competent and reasonable in cost. One class of materials for the sponge-like member 22 could be plastic consolidated particulate solids such as sand, ground walnut shells, plastic beads, or limestone. A second material could be compressed material particles such as steel, plastic or wood. Alternatively, a highly porous and permeable fired, unglazed ceramic or pottery material could be suitable. In the preferred embodiment, a foamed plastic material is used.

When any of the above listed materials is used in the sponge-like member 22, with the exception of foamed plastic, the embodiment disclosed in FIG. 2 is to be used. Each segment of the sponge-like member 22 is filled with the materials prior to the segment's insertion in the plastic inner barrel 20.

In the preferred embodiment, the sponge-like member 22 is composed of a foamed polyurethane. When the foamed polyurethane is used in the present invention, the embodiment disclosed in FIG. 1 is used. The inner and outer O-rings 32, 34, and elastic webbing 36 are not required in this embodiment.

The polyurethane foam sponge-like member 22 is made of one piece, and has the same length as the plastic inner liner 20. A hollow diameter 24 is formed in the middle of the polyurethane foam sponge-like member 22 during the production process, described below. The diameter 24 is dimensioned slightly smaller than the diameter of the well core 26 so that there is a tight fit between the well core 26 and the diameter 24. Diameter 24 has been dimensioned in one embodiment to be about one-sixteenth to one-eight of an inch smaller than the core 26. The physical contact with the well core 26 and the polyurethane foam sponge-like member 22 eliminates free formation fluid segregation common in prior art devices.

Figure 5:
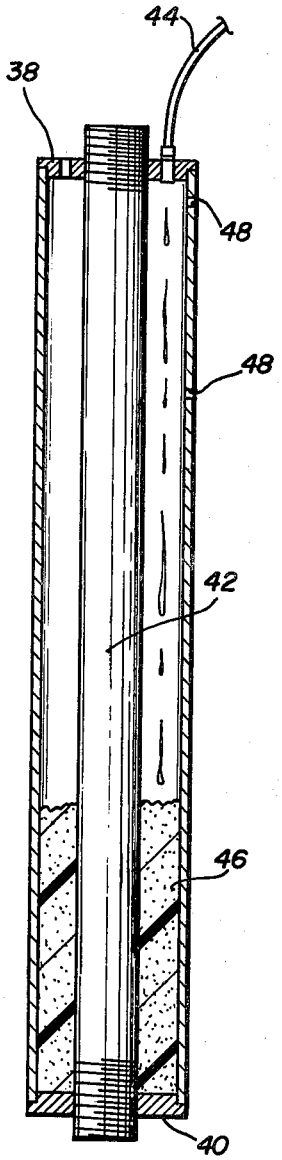
FIG. 5 is a cross-sectional view of the sponge-like member of the present invention.

Referring to FIG. 5, a method of producing a polyurethane foam sponge-like member 22 is to be described. A plastic inner liner 20, which may be composed of a polyvinyl chloride pipe, has caps 38, 40 attached at each end. A mandrel 42 is inserted in the plastic inner barrel 20, and the caps 38, 40 support the mandrel 42 therein. A foam injection line 44 is connected to the end cap 38 and permits injection of the polyurethane foam 46 into the plastic inner liner 20.

The polyurethane foam, catalyst and foaming agent are mixed in a manner well known to those of skill in the art prior to injection into the inner liner 20. The polyurethane foam is injected into the plastic inner liner to fill the space between the mandrel 42 and the liner 20. Perforations 48 may be drilled in the plastic inner liner 20 to allow excess polyurethane foam 46 to escape. The polyurethane foam, when setting, sticks to the polyvinyl chloride plastic inner liner 20, but not to the mandrel 42. After the foam has hardened, the mandrel 42 is removed from the plastic inner liner 20, and the caps 38, 40 are removed to form a sponge-like member 22 inside the plastic inner liner 20.

Mandrel 42 forms the diameter 24 of the sponge-like member 22. Thus, mandrel 42 has a diameter slightly smaller than the well core 26 which will be cut by bit 12, so that well core 26 will fit snugly in diameter 24.

As will be evident to those of skill in the art, other plastics which are capable of foam injection may be substituted for polyurethane foam, and the particular plastic will vary according to the subterranean fluids to be tested. In the case of an oil well, an oil wet sponge material is preferable.

A method of using the present invention 10 to obtain oil and water saturation data from a subterranean formation is next to be described. A sponge-like member 22 is provided in accordance with the materials described above, and inserted in an outer barrel 14. A metal inner barrel 16 is used as appropriate. A core bit 12 is attached to the end of the outer barrel 14, and a core-catcher 18 is secured to the metal inner barrel 16 or liner 20.

After an oil or gas well has been drilled in the subterranean formation, the present invention 10 is attached to a drill string (not shown) and lowered into the oil well. A well core 26 is drilled in the well in the subterranean formation, and is inserted in the diameter 24 of the sponge-like member 22. During the drilling operation, mud is added to the oil or gas well to maintain the pressure in the subterranean formation.

After the well core 26 has been drilled, the present invention 10 is withdrawn from the oil well. As the well core 26 is withdrawn from the enormous pressure of the subterranean formation, the fluids contained therein flow or "bleed" out. The sponge-like member 22 absorbs these fluids as they flow or "bleed" out, very much as a sponge absorbs water. The close physical contact between the core 26 and the sponge-like members 22 prevents gravity separation of the fluids which migrate from the well core 26.

After the well core 26 and sponge-like member 22 are withdrawn from the well, they can be cut into appropriate lengths and shipped to a laboratory for boiling and accurate analysis. In such a fashion, all of the fluid contained in the well core 26 is made available for accurate analysis of the contents of the subterranean formation.

Further, the present invention 10 holds the fluids in the sponge-like member 22 adjacent the points on the well core 26 from which they came, thus facilitating accurate analysis of the fluids in the subterranean formation.

The system of the present invention 10 can also be used to improve oil saturation analysis. The diameter 24 and the accompanying sponge-like member 22 can be filled with drilling mud prior to introduction of the present invention 10 into the oil or gas well for coring. The drilling mud lubricates the well core 26 as it is drilled and is introduced into the core barrel. Any excess drilling mud exits from the high porosity sponge-like member 22. A check valve could also be used to release the excess drilling mud, as is well known to those of skill in the art.

Fluid containing test material can also be added to the present invention 10 to allow the analysis of carbon dioxide in core samples. For example, solutions of sodium hydroxide (NaOH), calcium hydroxide ($Ca(OH)_2$), or ammonium hydroxide ($NH_4OH$) can be added to the drilling mud. As will be evident to those of skill in the art, measurement of the fluid containing materials after the present invention 10 is removed from the oil well reveals the carbon dioxide content of the core samples.

In a similar fashion, the present invention 10 can be used to analyze the water saturation of the subterranean formation. A tracer can be added to the sponge core fluid prior to drilling the well core 26. The fluid contained in the sponge-like member 22 after removal from the oil or gas well will disclose the water saturation of the subterranean formation. Such tracers could be nitrate ions, tritium, or any ion or cation which is not generally found in the drilling mud, such as barium.

While two embodiments of the present invention have been described in detail herein and shown in the accompanying drawings, it will be evident that various further modifications are possible without departing from the spirit and scope of the invention.

I claim:

1. Apparatus for recovery of subterranean fluid comprising:

means for boring a well core containing the subterranean fluid;

container means associated with said boring means for containing said well core; and an oil and water absorbent member having a predetermined configuration disposed in said container means and proximately positioned adjacent said well core, said absorbent member having sufficient permeability and porosity for absorbing the subterranean fluid as the subterranean fluid emanates from said well core and for storing the absorbed subterranean fluid for later retrieval.

2. The apparatus in claim 1 wherein said absorbing means comprises a hollow cylinder dimensioned to fit in said container means.

3. Apparatus for recovery of subterranean fluid comprising:

means for boring a well core containing the subterranean fluid;

container means associated with said boring means for containing said well core; and a hollow cylinder dimensioned to fit in said container means, said hollow cylinder comprising an oil and water absorbent sponge-like member and proximately positioned said well core for absorbing and storing subterranean fluid.

4. Apparatus for recovery of subterranean fluid comprising:

means for boring a well core containing the subterranean fluid;

container means associated with said boring means for containing said well core; and absorbing means in said container means and proximately positioned said well core for absorbing and storing the subterranean fluid, said absorbing means comprising a plurality of hollow cylinders longitudinally positioned in said container means.

5. The apparatus in claim 4 wherein said hollow cylinders comprise compressed particulates.

6. A device for recovery of fluids from a well core comprising:

means for boring the well core;

casing means for containing the well core and connecting said bore means to a drill string; and oil and water absorbent means comprising polyurethane foam contained in said casing means with a diameter receiving the well core for absorbing the fluids.

7. The device in claim 6 wherein said oil and water absorbent means comprises an elongate, hollow cylinder positioned in said casing means.

8. The device in claim 6 wherein said casing means comprises:

outer barrel means connecting said boring means to a drill string; and inner liner means for containing the well core and said oil and water absorbent means.

9. The device in claim 6 wherein said boring means comprises:

drill bit means for boring the well core; and well core holding means for supporting the well core.

10. A device for recovery of fluids from a well core comprising:

means for boring the well core;

casing means for containing the well core and connecting said boring means to a drill string; and oil and water absorbent means comprising plastic consolidated particulate solids contained in said casing means with a diameter receiving the well core for absorbing the fluids.

11. A device for recovery of fluids from a well core comprising:

means for boring the well core;

casing means for containing the well core and connecting said boring means to a drill string; and oil and water absorbent means comprising a porous and permeable ceramic cylinder contained in said casing means with a diameter receiving the well core for absorbing the fluids.

12. A device for recovery of fluids from a well core comprising:

means for boring the well core;

casing means for containing the well core and connecting said boring means to a drill string, said casing means including an outer barrel means connecting said boring means to a drill string and inner liner means for containing the well core and said oil and water absorbent means, said inner liner comprising a polyvinyl chloride pipe, and oil and water absorbent means contained in said casing means with a diameter receiving the well core for absorbing the fluids.

13. A device for recovery of fluids from a wall core comprising:

casing means for containing the well core and connecting said bore means to a drill string, said casing means including an outer barrel means connecting said boring means to a drill string and inner liner means for containing the well core and said oil and water absorbent means, said inner liner having a plurality of perforations, and oil and water absorbent means containing in said casing means with a diameter receiving the well core for absorbing the fluids.

14. A device for recovery of fluids from a well core comprising:

means for boring the well core;

casing means for containing the well core and connecting said boring means to a drill string; and oil and water absorbent means contained in said casing means with a diameter receiving the well core for absorbing the fluids, said absorbent means comprising a plurality of longitudinally oriented segments of absorbent material.

15. The device in claim 14 wherein said plurality of segments of absorbent material are separated by impermeable members.

16. A device for recovering subterranean fluids comprising:

a drill bit for boring a well core containing the fluids;

a core holding means for guiding said well core;

an outer barrel attached to said drill bit and containing said core holding means;

an inner liner positioned in said outer barrel for receiving said well core; and an oil absorbent sponge-like member contained in said inner barrel with a diameter dimensioned to receive said well core for absorbing and storing the fluids contained in said well core.

17. The device in claim 16 wherein said oil absorbent sponge core is selected from the group consisting of sand, ground walnut shells, plastic beads, limestone, compressed plastic particles, compressed steel particles, compressed wood particles, and polyurethane foam.

18. The device in claim 16 wherein said oil absorbent sponge-like member comprises a plurality of longitudinally oriented segments of oil absorbing material.

19. The device in claim 18 wherein said oil absorbing material is selected from the group consisting of sand, ground walnut shells, plastic beads, limestone, compressed plastic particles, compressed steel particles, compressed wood particles, and polyurethane foam.

20. The device in claim 18 wherein said segments are separated by oil impermeable means.

21. The device in claim 20 wherein said oil impermeable means comprises:

an outer elastic O-ring dimensioned to fit around said outer barrel;

an inner elastic O-ring dimensioned to fit around said well core; and elastic webbing connecting said O-rings.

22. The device in claim 16 wherein said inner liner comprises polyvinyl chloride pipe.

23. The device in claim 22 wherein said polyvinyl chloride pipe has a plurality of perforations.

24. The device in claim 16 wherein said diameter is filled with drilling mud to lubricate said well core and improve oil saturation.

25. The device in claim 16 wherein said diameter is filled with test fluid for analyzing the carbon dioxide content of said fluids.

26. The device in claim 25 wherein said fluid is selected from the group consisting of sodium hydroxide, ammonium hydroxide, and calcium hydroxide.

27. The device of claim 26 wherein said tracer fluid is selected from the group consisting of tritium, nitrate ions, and barium ions.

28. The device in claim 26 wherein said tracer fluid comprises a cation solution.

29. The device in claim 28 wherein said pipe has a plurality of perforations.

30. The device in claim 26 wherein said tracer fluid comprises an ion solution.

31. The device in claim 16 wherein said diameter is filled with a tracer fluid.

32. The device in claim 16 wherein said diameter of said core member is filled with a fluid for lubrication.

33. The device in claim 16 wherein said inner liner comprises a metal pipe.

34. A method of obtaining subterranean fluid from an oil well comprising the steps of:

boring a well core in the oil well;

positioning a sponge-like absorbent member proximate said well core during boring;

removing said well core and said sponge-like absorbent member from the oil well; and absorbing the fluid from said well core with said sponge-like absorbent member.

35. A method of obtaining subterranean fluid from an oil well comprising the steps of:

forming an oil absorbent sponge-like member with a hollow diameter;

positioning said sponge-like member in a container means;

associating a boring means with said container means;

boring a well core in the oil well dimensioned to fit in said hollow diameter;

inserting said well core in said hollow diameter;

removing said well core and said sponge-like member from the oil well; and absorbing the fluid from said well core with said sponge-like member.

36. The method of claim 34 or 35 wherein said oil absorbent sponge-like member is formed by:

positioning upper and lower caps on a pipe;

supporting a mandrel in said pipe with said caps;

filling said pipe with a foaming plastic; and removing said caps and said mandrel from said pipe.

* * * * *

UNITED STATES PATENT AND TRADEMARK OFFICE

CERTIFICATE OF CORRECTION

PATENT NO. : 4,312,414

DATED : January 26, 1982

INVENTOR(S) : Arthur Park

It is certified that error appears in the above–identified patent and that said Letters Patent are hereby corrected as shown below:

Column 3, line 32, "thse" should be --those--;
line 36, after "wet" delete "-".
Column 4, lines 60-61, "members" should be --member--.
Column 7, line 2, "bore" should be --boring--;
line 8, "containing" should be --contained--.

Signed and Sealed this

First Day of June 1982

[SEAL]

*Attest:*

GERALD J. MOSSINGHOFF

*Attesting Officer*

*Commissioner of Patents and Trademarks*